US010862230B2

(12) United States Patent
Osaki

(10) Patent No.: US 10,862,230 B2
(45) Date of Patent: Dec. 8, 2020

(54) TRIGGER SWITCH

(71) Applicant: Omron Corporation, Kyoto (JP)

(72) Inventor: Kazufumi Osaki, Okayama (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/484,176

(22) PCT Filed: Dec. 13, 2017

(86) PCT No.: PCT/JP2017/044734
§ 371 (c)(1),
(2) Date: Aug. 7, 2019

(87) PCT Pub. No.: WO2018/168131
PCT Pub. Date: Sep. 20, 2018

(65) Prior Publication Data

US 2019/0356066 A1 Nov. 21, 2019

(30) Foreign Application Priority Data

Mar. 14, 2017 (JP) ..... 2017-049049

(51) Int. Cl.
*H01H 13/08* (2006.01)
*H01R 9/22* (2006.01)
(Continued)

(52) U.S. Cl.
CPC ..... *H01R 9/223* (2013.01); *H01H 13/10* (2013.01); *H01H 13/14* (2013.01); *H01R 9/16* (2013.01);
(Continued)

(58) Field of Classification Search
CPC .... H01H 13/08; H01R 13/428; H01R 13/432; H01R 13/20; H01R 12/91; H01R 13/6315
See application file for complete search history.

(56) References Cited

U.S. PATENT DOCUMENTS 4,553,005 A * 11/1985 Glenn ..... H01H 9/061 200/241
4,839,483 A * 6/1989 Doyle ..... H01H 1/585 200/302.1
(Continued)

FOREIGN PATENT DOCUMENTS

EP 1 936 645 A1 6/2008
JP 4941048 B2 5/2012
(Continued)

OTHER PUBLICATIONS

International Search Report issued in PCT/JP2017/044734 dated Mar. 20, 2018 (1 page).
(Continued)

*Primary Examiner* — Felix O Figueroa
(74) *Attorney, Agent, or Firm* — Osha Bergman Watanabe & Burton LLP

(57) ABSTRACT

A trigger switch includes a housing including a casing; a trigger coupled to the housing to be capable of approaching and separating from the housing; a contact mechanism; a first terminal extending from outside of the housing to the casing; and a second terminal extending from outside of the housing to the casing and including a plate surface facing a plate surface of the first terminal. A first wire connection portion capable of connecting a conductor portion of a first wire is provided to an end of the first terminal located outside of the housing in an extending direction of the first terminal, and a second wire connection portion capable of connecting a conductor portion of a second wire is provided to an end of the second terminal located outside of the housing in an extending direction of the second terminal.

6 Claims, 5 Drawing Sheets

(51) Int. Cl.

| | |
|---|---|
| ***H01H 13/10*** | (2006.01) |
| ***H01H 13/14*** | (2006.01) |
| ***H01R 9/16*** | (2006.01) |
| ***H01R 13/20*** | (2006.01) |
| ***H01R 13/432*** | (2006.01) |
| ***H01R 13/428*** | (2006.01) |
| ***H01R 12/91*** | (2011.01) |
| ***H01R 13/631*** | (2006.01) |
| *H01R 4/34* | (2006.01) |

(52) U.S. Cl.
CPC ..... *H01R 12/91* (2013.01); *H01R 13/20* (2013.01); *H01R 13/428* (2013.01); *H01R 13/432* (2013.01); *H01R 13/6315* (2013.01); *H01H 13/08* (2013.01); *H01H 2207/026* (2013.01); *H01R 4/34* (2013.01)

(56) References Cited

U.S. PATENT DOCUMENTS

| | | | | |
|---|---|---|---|---|
| 7,198,526 | B1 * | 4/2007 | MacNeil ..... | H01R 4/185 439/881 |
| 7,211,758 | B2 * | 5/2007 | Lui ..... | H01H 1/20 200/341 |
| 9,373,461 | B2 * | 6/2016 | Hozumi ..... | H01H 13/06 |
| 2008/0314721 | A1 | 12/2008 | Arataki et al. | |
| 2012/0234657 | A1 | 9/2012 | Nishikimi et al. | |
| 2013/0037398 | A1 | 2/2013 | Kobayashi et al. | |
| 2017/0352499 | A1 | 12/2017 | Koyama et al. | |

FOREIGN PATENT DOCUMENTS

| | | | |
|---|---|---|---|
| JP | 2012-206248 | A | 10/2012 |
| JP | 2013-041715 | A | 2/2013 |
| JP | 2016-171031 | A | 9/2016 |

OTHER PUBLICATIONS

Written Opinion of the International Searching Authority issued in PCT/JP2017/044734 dated Mar. 20, 2018 (4 pages).

Office Action issued in the counterpart Japanese Patent Application No. 2017-049049, dated Dec. 17, 2019 (6 pages).

* cited by examiner

TRIGGER SWITCH

TECHNICAL FIELD

The present disclosure relates to a trigger switch.

BACKGROUND ART

The trigger switch disclosed in PTL 1 includes a housing, a trigger provided to the exterior of the housing and coupled to the housing to be capable of approaching to and separating from the housing, a contact mechanism provided in the housing, the contact mechanism operating in conjunction with the approaching and separating operation of the trigger with respect to the housing, and a pair of screw power connection terminals electrically connected to the contact mechanism.

With respect to the trigger switch, the power connection terminals, which are provided in the housing, each have a connection portion that is fixed on the outer surface of the housing and to which an electric wire is connected, and a terminal portion disposed inside the housing and connected to the contact mechanism.

CITATION LIST

Patent Literature

PTL 1: U.S. Pat. No. 4,941,048

SUMMARY OF INVENTION

Technical Problem

In recent years, along with a reduction in the size and weight of power tools, such as electric screwdrivers, in particular, space for housing a housing of a trigger switch for use in the power tools is often limited. However, in the trigger switch, since the pair of power connection terminals are provided in the housing, it is difficult to miniaturize the housing, and there are cases where it is impossible to cope with the reduction in the size and weight of the power tools.

An object of the present disclosure is to provide a trigger switch that can achieve miniaturization of a housing.

Solution to Problem

A trigger switch according to an aspect of the present disclosure comprising:

a housing internally including a casing;

a trigger, which is provided to an exterior of the housing, coupled to the housing so as to be capable of approaching to and separating from the housing;

a contact mechanism including a fixed contact provided in the casing and a movable contact provided in the casing so as to face the fixed contact, the movable contact making contact with and separating from the fixed contact in conjunction with approaching and separating operation of the trigger with respect to the housing;

a first terminal, which has a plate shape, fixed to the housing and electrically connected to the contact mechanism, the first terminal extending from outside of the housing to the casing; and a second terminal, which has a plate shape, fixed to the housing and electrically connected to the contact mechanism, the second terminal extending from outside of the housing to the casing and having a plate surface facing a plate surface of the first terminal and being disposed in parallel with the first terminal, wherein a first wire connection portion capable of connecting a conductor portion of a first wire is provided to an end of the first terminal located outside of the housing in an extending direction of the first terminal, and a second wire connection portion capable of connecting a conductor portion of a second wire is provided to an end of the second terminal located outside of the housing in an extending direction of the second terminal.

Advantageous Effects of Invention

In the trigger switch according to the above aspect, the first wire connection portion capable of connecting the conductor portion of the first wire is provided to the end of the first terminal located outside of the housing in the extending direction of the first terminal. In addition, the second wire connection portion capable of connecting the conductor portion of the second wire is provided to the end of the second terminal located outside of the housing in the extending direction of the second terminal. Thus, for example, as compared to a trigger switch in which a wire connection portion is provided in a housing, it is possible to miniaturize the housing by eliminating the space occupied by the wire connection portion in the housing, and cope with the reduction in the size and weight of power tools.

DESCRIPTION OF EMBODIMENT

Hereinafter, an embodiment of the present disclosure will be described according to the attached drawings. In the following description, terms that indicate specific directions or positions (for example, terms including "upper", "lower", "right", and "left") are used when necessary, but use of those terms is to facilitate the understanding of the disclosure with reference to the drawings, and the technical scope of the present disclosure is not limited by the meaning of those terms. In addition, the following description is merely illustrative in nature and is not intended to limit the disclosure or the application and uses of the disclosure. Furthermore, the drawings are schematic, and the ratios of dimensions and the like do not necessarily match the actual ones.

Figure 1:
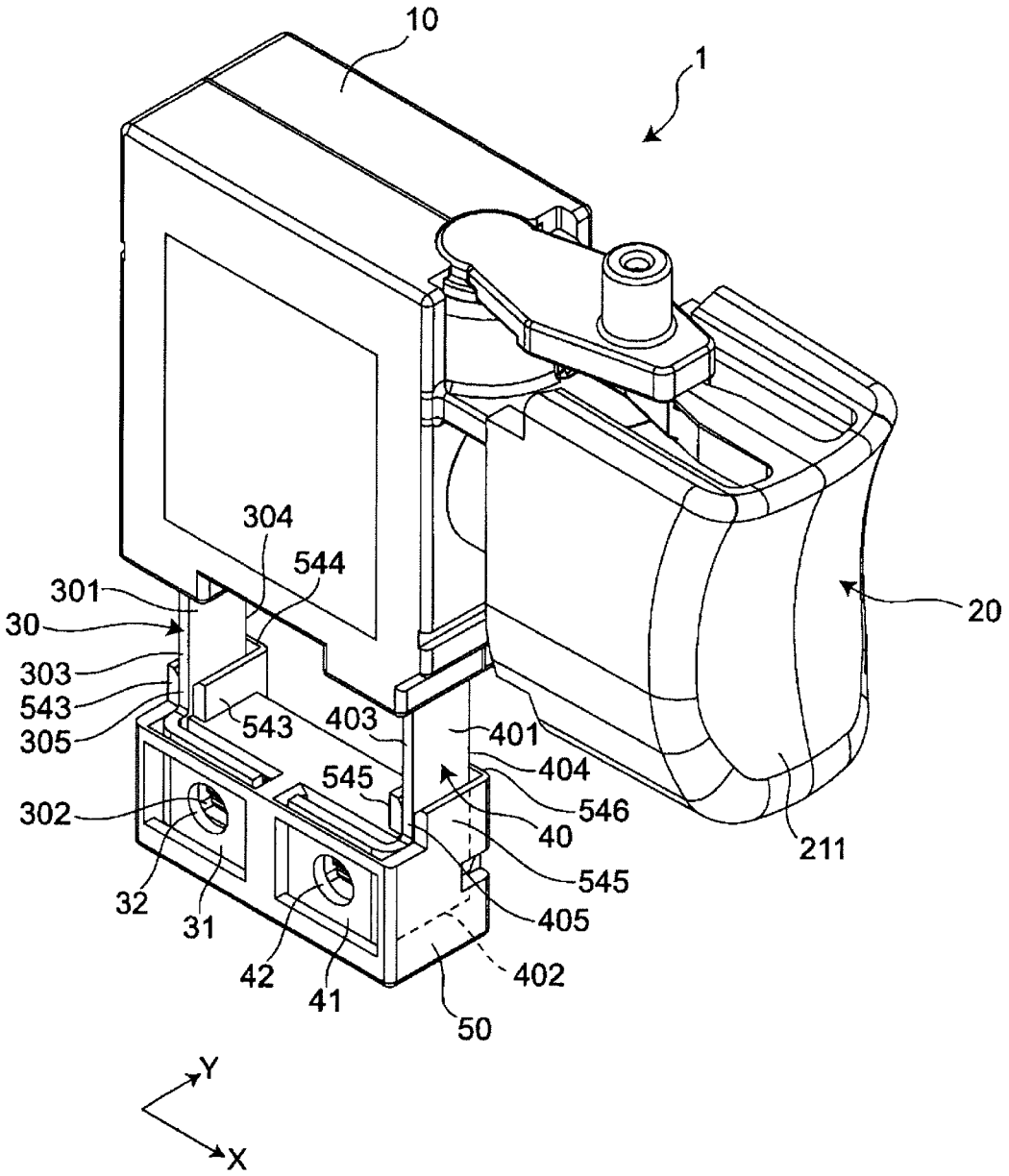
FIG. 1 is a perspective view of a trigger switch according to an embodiment of the present disclosure.

A trigger switch 1 according to an embodiment of the present disclosure includes, as shown in FIG. 1, an insulating housing 10, an insulating trigger 20, a conductive first terminal 30, and a conductive second terminal 40.

The first terminal 30 and the second terminal 40 extend downward (i.e., downward in FIG. 1) from the lower end of the housing 10 (i.e., the lower end in FIG. 1), respectively. A first wire connection portion 31 is provided at a leading end of the first terminal 30 located outside of the housing 10 in a direction in which the first terminal 30 extends (i.e., an extending direction of the first terminal 30). And a second wire connection portion 41 is provided at a leading end of the second terminal 40 located outside of the housing 10 in an extending direction of the second terminal 40.

Figure 2:
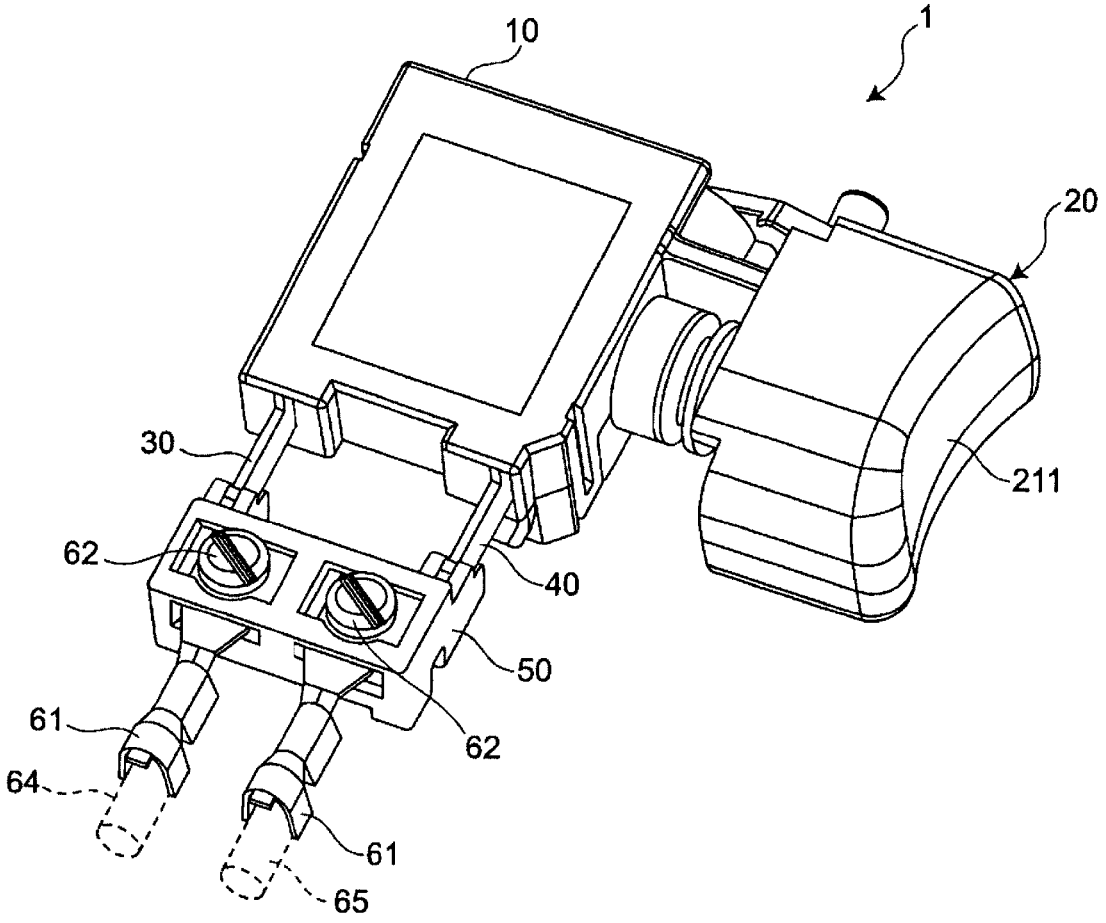
FIG. 2 is a perspective view showing a state in which crimp terminals are attached to a first wire connection portion and a second wire connection portion of the trigger switch of FIG. 1.

In this embodiment, as an example, the first wire connection portion 31 and the second wire connection portion 41 are housed in an insulating terminal cover member 50 having a box shape, and, as shown in FIG. 2, crimp terminals 61 are fixed by screws 62. The first wire connection portion 31 and the second wire connection portion 41 are connected via the crimp terminals 61 to a conductor portion 64 of a first wire and a conductor portion 65 of a second wire, respectively.

Figure 3:
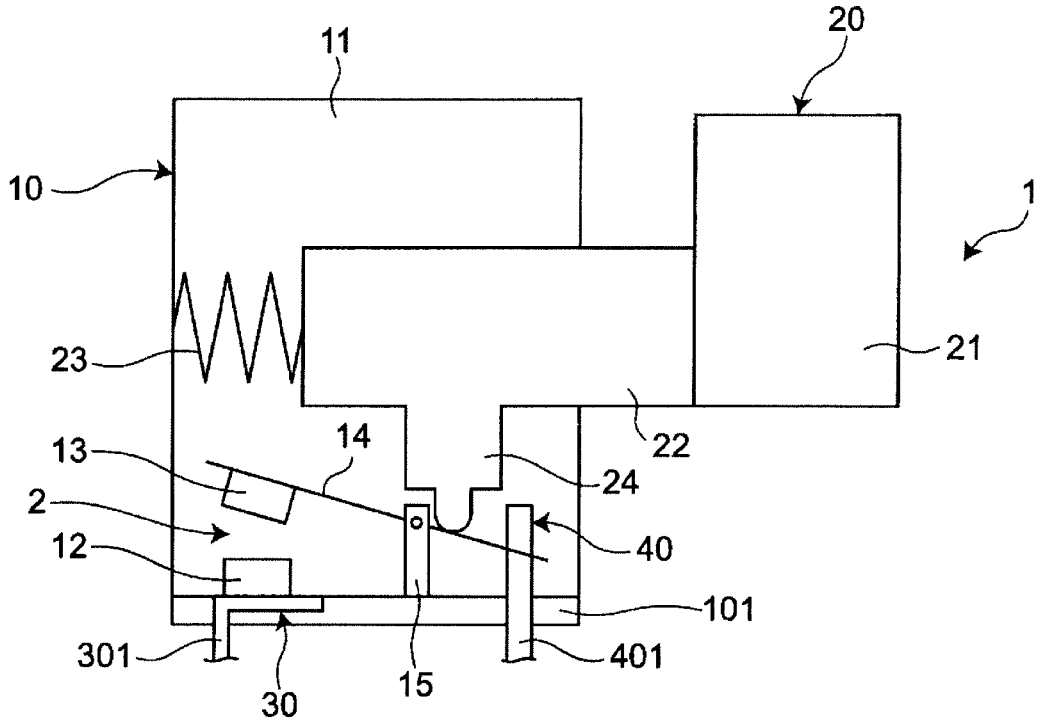
FIG. 3 is a schematic view for explaining the return state of the trigger switch of FIG. 1.
Figure 4:
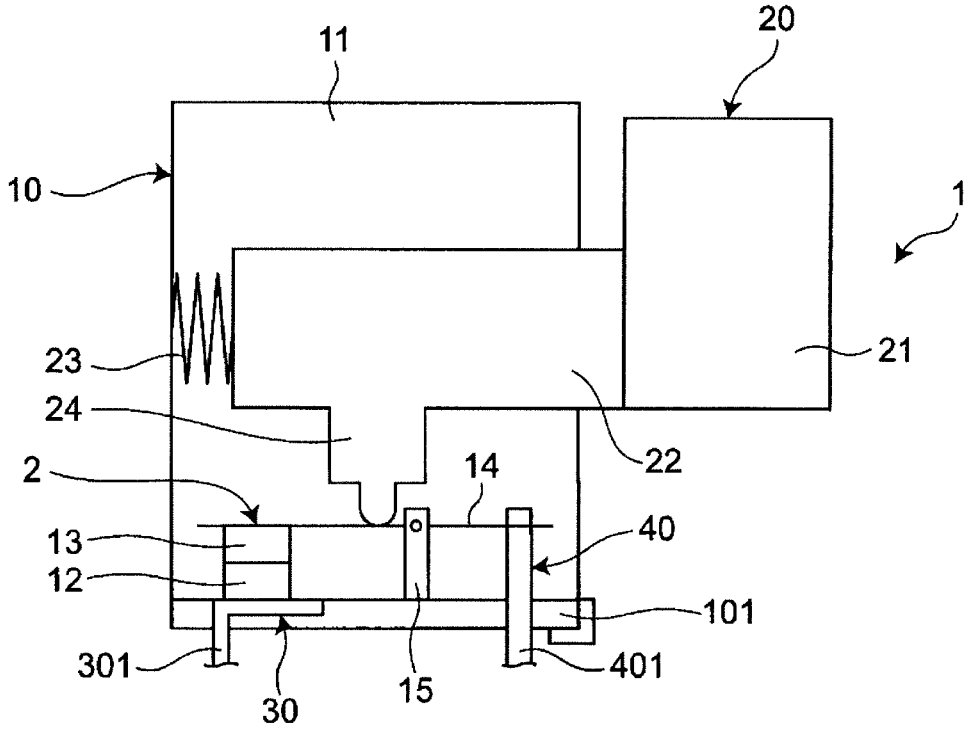
FIG. 4 is a schematic view for explaining the operating state of the trigger switch of FIG. 1.

As shown in FIGS. 3 and 4, the housing 10 includes a casing 11 therein. A contact mechanism 2 electrically connected to the first terminal 30 and the second terminal 40 is provided in the casing 11.

The housing 10, as shown in FIG. 1, has a substantially rectangular box shape. The trigger 20 coupled to the housing 10 to be capable of approaching to and separating from the housing 10 is disposed on the exterior of the housing 10.

The contact mechanism 2 includes a fixed contact 12 and a movable contact 13 as shown in FIGS. 3 and 4. FIGS. 3 and 4 schematically show the trigger switch 1 with portions of the housing 10 removed. FIG. 3 shows the trigger switch 1 in a return state in which the fixed contact 12 and the movable contact 13 are separated, and FIG. 4 shows the trigger switch 1 in an operating state in which the fixed contact 12 and the movable contact 13 are in contact.

The fixed contact 12 is fixed to the conductive first terminal 30 in the casing 11, and electrically connected to the first terminal 30.

The first terminal 30 includes a first terminal body 301 of a plate shape extending from outside the housing 10 to the casing 11 and the first wire connection portion 31 provided to the first terminal body 301. The first terminal body 301 is fixed to an end of a wall 101 on a lower side (i.e., a lower side in the Z direction in FIGS. 3 and 4) of the housing 10 away from the trigger 20 as viewed in the approaching and separating direction (i.e., a left-right direction in FIGS. 3 and 4) in which the trigger 20 approaches to and separates from the housing 10.

As shown in FIG. 1, the first wire connection portion 31 has a substantially square shape in a plan view along a plate width direction of the first terminal body 301 (i.e., the Y direction in FIG. 1). A circular through hole 32 into which the screw 62 shown in FIG. 2 can be inserted is provided in a center of the first wire connection portion 31. The first wire connection portion 31 is disposed on a first side surface 303 (i.e., the surface on the left side in the Y direction in FIG. 1), which is one of a pair of first and second side surfaces 303, 304 of an end 302 of the first terminal body 301 located outside of the housing 10 which face each other in the plate width direction. The first wire connection portion 31 extends in a direction intersecting (for example, substantially orthogonal to) the plate surface of the first terminal body 301 and approaching to the second terminal 40.

The movable contact 13 is fixed to a movable contact piece 14 in the casing 11, and electrically connected to the conductive second terminal 40 via the movable contact piece 14. The movable contact 13 faces the fixed contact 12, and is disposed to be capable of contact with and separating from the fixed contact 12.

The movable contact piece 14 has a long thin plate shape extending in the approaching and separating direction of the trigger 20, and is turnably supported by a supporting portion 15 at an intermediate portion of the movable contact piece 14 in a longitudinal direction of the movable contact piece 14. The supporting portion 15 is provided substantially at the center of the wall 101 of the housing 10 in the approaching and separating direction of the trigger 20. The movable contact 13 is fixed to one end (i.e., a left end in FIGS. 3 and 4) of the movable contact piece 14 in the longitudinal direction of the movable contact piece 14. The other end (i.e., a right end in FIGS. 3 and 4) of the movable contact piece 14 in the longitudinal direction of the movable contact piece 14 is in contact with the second terminal 40.

The second terminal 40 includes a second terminal body 401 having a plate shape that extends from outside the housing 10 to the casing 11 and the second wire connection portion 41 provided to the second terminal body 401. The second terminal body 401 is fixed to the end of the wall 101 on the lower side of the housing 10 toward the trigger 20 in the approaching and separating direction of the trigger 20 and is electrically independent of the first terminal 30. The second terminal body 401, with a plate surface facing a plate surface of the first terminal body 301, is disposed in parallel with the first terminal body 301.

As shown in FIG. 1, the second wire connection portion 41 has a substantially square shape in a plan view along the plate width direction of the second terminal body 401 (i.e., the Y direction in FIG. 1). A circular through hole 42 into which the screw 62 shown in FIG. 2 can be inserted is provided in a center of the second wire connection portion 41. The second wire connection portion 41 is disposed on a first side surface 403 (i.e., the surface on the left side in the Y direction in FIG. 1), which is one of a pair of first and second side surfaces 403, 404 of an end 402 of the second terminal body 401 located outside of the housing 10 which face each other in the plate width direction. The second wire connection portion 41 extends in a direction intersecting (for example, substantially orthogonal to) the plate surface of the second terminal body 401 and approaching to the first terminal 30.

As shown in FIGS. 3 and 4, the trigger 20 includes an operation body 21 and an operation shaft 22. The operation body 21 is disposed on one side in the short-side direction of the housing 10 (i.e., the left-right direction in FIGS. 3 and 4) and operated by a user with a finger. The operation shaft 22 extends from the surface of the operation body 21 facing the housing 10 toward the housing 10 to the interior of the housing 10.

The operation body 21 has a curved surface 211 (shown in FIG. 1) on the surface away from the housing 10 in the approaching and separating direction of the trigger 20 so that the operation body 21 is easily operated by the finger of the user.

As shown in FIGS. 3 and 4, the operation shaft 22 includes a first end and a second end in the extending direction of the operation shaft 22 (i.e., the left-right direction in FIGS. 3 and 4). The first end is coupled to the operation body 21 outside of the housing 10. The second end is coupled to the housing 10 to be movable within the casing 11 of the housing 10. A return spring 23 which biases the operation shaft 22 in a direction in which the trigger 20 separates from the housing 10 is provided to the second end of the operation shaft 22 in the extending direction thereof.

The operation shaft 11 includes a plunger 24 extending toward the wall 101 of the housing 10 from the operation shaft 22 in the casing 11. The plunger 24 is disposed such that a leading end thereof (i.e., a lower end in FIGS. 3 and 4) can make contact with the movable contact piece 14 in conjunction with the movement of the trigger 20.

That is, the movable contact 13 makes contact with and separates from the fixed contact 12 in conjunction with the approaching and separating operation of the trigger 20 as follows.

When the trigger 20 is moved toward the housing 10 by operating the operation body 21 of the trigger 20 of the trigger switch 1 in the return state shown in FIG. 3, the trigger approaching the housing, the plunger 24 makes contact with the movable contact piece 14 further toward the first terminal 30 side than the supporting portion 15 in conjunction with the movement of the trigger 20 in a direction approaching the housing 10 (i.e., an approaching operation), and turns the movable contact piece 14 in a counterclockwise direction in a plan view taken along a direction of the rotation axis of the movable contact piece 14 (i.e., a direction penetrating the drawing sheet of FIG. 3 and FIG. 4). Thus, the movable contact 13 is brought close to the wall 101 on the lower side of the housing 10 into contact with the fixed contact 12, resulting in the operating state shown in FIG. 4.

When the finger is released from the operation body 21 of the trigger 20 of the trigger switch 1 in the operating state shown in FIG. 4, the return spring 23 biases the operation shaft 22 in a direction in which the trigger 20 separates from the housing 10, to move the trigger 20 in the direction in which the trigger 20 separates from the housing 10. The plunger 24 makes contact with the movable contact piece 14 further toward the second terminal 40 side than the supporting portion 15 in conjunction with the movement of the trigger 20 in a direction separating from the housing 10 (i.e., a separating operation) and turns the movable contact piece 14 in a clockwise direction in a plan view taken along the direction of the rotation axis of the movable contact piece 14. Thus, the movable contact 13 moves away from the wall 101 on the lower side of the housing 10 and separates from the fixed contact 12, resulting in the return state shown in FIG. 3.

Figure 5:
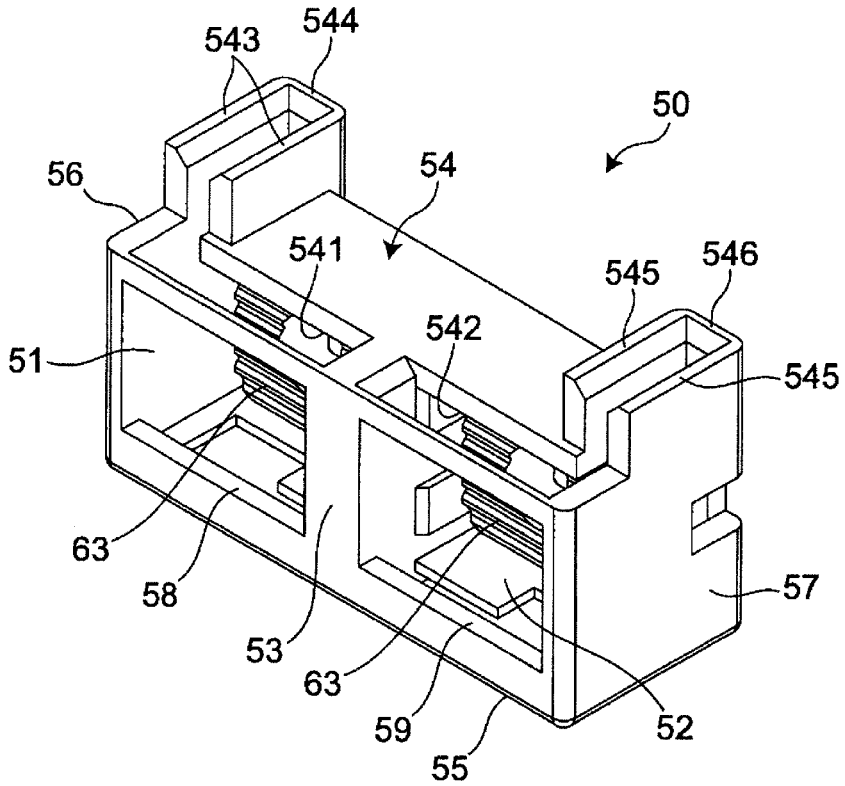
FIG. 5 is a perspective view of a terminal cover member of the trigger switch of FIG. 1.
Figure 6:
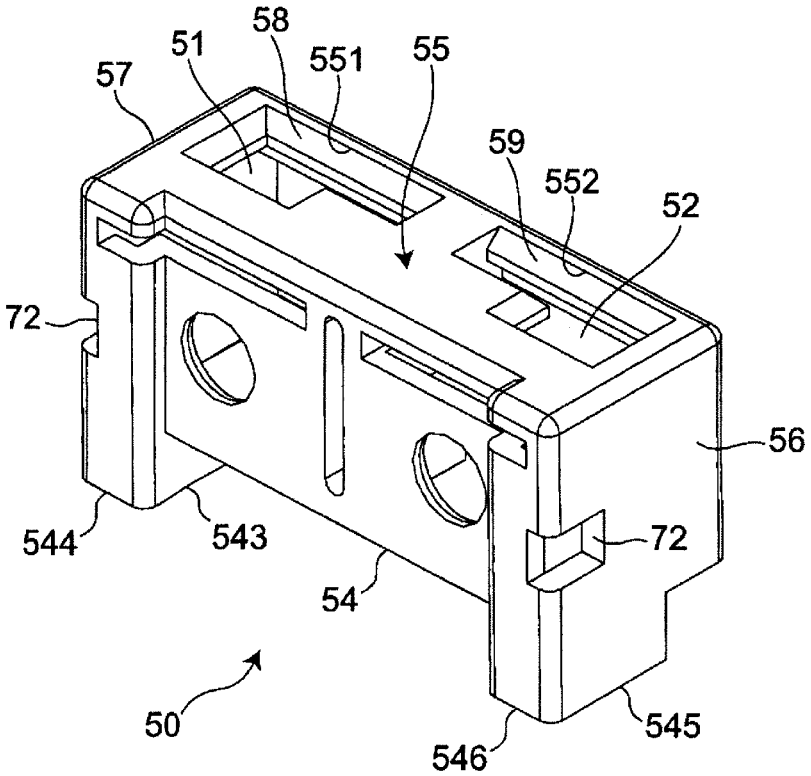
FIG. 6 is a perspective view of the terminal cover member of the trigger switch of FIG. 1 as viewed from a direction different from that of FIG. 5.

As shown in FIGS. 5 and 6, the terminal cover member 50 has a substantially rectangular parallelepiped shape. The terminal cover member 50 includes therein a first casing 51 that houses the first wire connection portion 31 and a second casing 52 that houses the second wire connection portion 41. FIG. 5 shows nuts 63 which are housed within the first casing 51 and the second casing 52 and fix the crimp terminals 61 to the first wire connection portion 31 and the second wire connection portion 41 together with the screws 62 shown in FIG. 2.

More specifically, the terminal cover member 50 includes a partition wall 53, a terminal insertion surface 54, a wire connection surface 55, a first side wall 56 and a second side wall 57. The partition wall 53 partitions the first casing 51 and the second casing 52 and thereby provides electrical isolation therebetween. The terminal insertion surface 54 and the wire connection surface 55 extend in a direction intersecting (for example, substantially orthogonal to) the partition wall 53. The first side wall 56 and the second side wall 57 are arranged to face the partition wall 53. The second side wall 57 is disposed on the opposite side of the partition wall 53 to the first side wall 56.

The partition wall 53 extends in the extending direction of the first terminal body 301 and the second terminal body 401, and is provided at a central portion in a longitudinal direction of the terminal cover member 50 when viewed along an extending direction of the partition wall 53 (i.e., an up-and-down direction in FIGS. 5 and 6).

The terminal insertion surface 54, which has a rectangular shape as shown in FIG. 5, is connected to an end of the partition wall 53 toward the housing 10 in the extending direction of the partition wall 53 (i.e., an upper side in FIG. 5). The terminal insertion surface 54 includes a first terminal insertion opening 541 into which the first wire connection portion 31 can be inserted and a second terminal insertion opening 542 into which the second wire connection portion 41 can be inserted.

The first terminal insertion opening 541 and the second terminal insertion opening 542 each have a substantially L shape extending along a longitudinal direction and a short-side direction of the terminal insertion surface 54, and are arranged symmetrically with respect to the partition wall 53. The first terminal body 301 can be inserted into a portion of the first terminal insertion opening 541 extending in the longitudinal direction of the terminal insertion surface 54. The first wire connection portion 31 can be inserted into the portion of the first terminal insertion opening 541 extending in the short-side direction of the terminal insertion surface 54. Similarly, the second terminal body 401 can be inserted into a portion of the second terminal insertion opening 542 extending in the longitudinal direction of the terminal insertion surface 54. The second wire connection portion 41 can be inserted into the portion of the second terminal insertion opening 542 extending in the short-side direction of the terminal insertion surface 54. That is, the terminal insertion surface 54 extends in a direction intersecting the partition wall 53, and is configured such that the first wire connection portion 31 can be inserted into the first casing 51 and the second wire connection portion 41 is inserted into the second casing 52.

The wire connection surface 55, which has a rectangular shape as shown in FIG. 6, is connected to an end of the partition wall 53 away from the housing 10 in the extending direction of the partition wall 53 (i.e., the lower side in FIG. 5). The wire connection surface 55 includes a first wire connection opening 551 into which the conductor portion 64 of the first wire can be inserted and a second wire connection opening 552 into which the conductor portion 65 of the second wire can be inserted. That is, the wire connection surface 55 extends in the direction intersecting the partition wall 53, and is disposed to face the terminal insertion surface 54. The wire connection surface 55 is configured such that the conductor portion 64 of the first wire can be connected to the first wire connection portion 31 and the conductor portion 65 of the second wire can be connected to the second wire connection portion 41.

The first wire connection opening 551 and the second wire connection opening 552 each have an L-shape extending along the longitudinal direction and the short-side direction of the terminal insertion surface 54 and are arranged symmetrically with respect to the partition wall 53.

The first wire connection opening 551 is formed partly from a first support wall 58 described later, and configured to prevent the first terminal body 301 and the first wire connection portion 31, which are inserted into the first casing 51 through the first terminal insertion opening 541, from penetrating the wire connection surface 55 to move outside the terminal cover member 50. Similarly, the second wire connection opening 552 is formed partly from a second support wall 59 described later, and configured to prevent the second-terminal body 401 and the second wire connection portion 41, which are inserted into the second casing 52 through the second terminal insertion opening 542, from penetrating the wire connection surface 55 to move outside the terminal cover member 50.

The first side wall 56 guides along the direction intersecting the terminal insertion surface 54, while supporting an outside plate surface that does not face the second terminal body 401 among a pair of plate surfaces of the first terminal body 301 inserted into the first casing 51 through the first terminal insertion opening 541 of the terminal insertion surface 54.

The second side wall 57 guides along the direction intersecting the terminal insertion surface 54 while supporting an outside plate surface that does not face the first terminal body 301 among a pair of plate surfaces of the second terminal body 401 inserted into the second casing 52 through the second terminal insertion opening 542 of the terminal insertion surface 54.

The first support wall 58 and the second support wall 59 which each extend along the wire connection surface 55 are provided to the wire connection surface 55. The second support wall 59 is disposed on the opposite side of the partition wall 53 to the first support wall 58.

The first support wall 58 constitutes a portion of the first wire connection opening 551. The first support wall 58 is provided to allow contact with the leading ends of the first terminal body 301 and first wire connection portion 31, which are inserted into the first casing 51 through the first terminal insertion opening 541 of the terminal insertion surface 54, in the first casing 51. That is, the first terminal body 301 and first wire connection portion 31 inserted through the first terminal insertion opening 541 are supported and positioned by the first support wall 58 in the first casing 51.

The second support wall 59 constitutes a portion of the second wire connection opening 552. The second support wall 59 is provided to allow contact with the leading ends of the second terminal body 401 and second wire connection portion 41, which are inserted into the second casing 52 through the second terminal insertion opening 542 of the terminal insertion surface 54, in the second casing 52. That is, the second terminal body 401 and second wire connection portion 41 inserted through the second terminal insertion opening 542 are supported and positioned by the second support wall 59 in the second casing 52.

In the trigger switch 1, the first wire connection portion 31 to which the conductor portion 64 of the first wire can be connected is provided to the end 302 of the first terminal 30 located outside of the housing 10 in the extending direction of the first terminal 30. And the second wire connection portion 41 to which the conductor portion 65 of the second wire can be connected is provided to the end 402 of the second terminal 40 located outside of the housing in the extending direction of the second terminal 40. Thus, for example, as compared with a trigger switch in which a wire connection portion is provided in a housing, it is possible to miniaturize the housing 10 by eliminating the space occupied by the wire connection portion in the housing, and cope with the reduction in the size and weight of power tools.

The trigger switch 1 also includes the insulating terminal cover member 50 having the first casing 51 that houses the first wire connection portion 31 and the second casing 52 that houses the second wire connection portion 41. Thus, even if the first wire connection portion 31 and the second wire connection portion 41 are arranged outside the housing 10, it is possible to provide absolute and reliable isolation therebetween with a simple configuration.

Furthermore, as shown in FIG. 5, the terminal cover member 50 includes a pair of first terminal support walls 543 and a pair of second terminal support walls 545. The pair of first terminal support walls 543 extend from the terminal insertion surface 54 along the plate surfaces of the first terminal body 301 toward the housing 10 to support the first terminal body 301. The pair of second terminal support walls 545 extend from the terminal insertion surface 54 along the plate surfaces of the second terminal body 401 toward the housing 10 to support the second terminal body 401. The pair of first terminal support walls 543 are connected by a first connection wall 544 that faces and supports the second side surface 304 of the first terminal body 301 (i.e., a surface on the right side in the Y direction in FIG. 1). The pair of second terminal support walls 545 are connected by a second connection wall 546 that faces and supports the second side surface 404 of the second terminal body 401 (i.e., a surface on the right side in the Y direction in FIG. 1).

That is, as shown in FIG. 1, the pair of first terminal support walls 543 are provided on each side in the plate thickness direction of the first terminal body 301. The pair of first terminal support walls 543 support a base 305 on the terminal cover member 50 side of the first terminal body 301 located outside of the housing 10 and outside of the terminal cover member 50. The pair of second terminal support walls 545 are provided on each side in the plate thickness direction of the second terminal body 401. The pair of second terminal support walls 545 support a base 405 on the terminal cover member 50 side of the second terminal body 401 located outside of the housing 10 and outside of the terminal cover member 50. The bases 305 and 405 are prone to stress concentration. Therefore, the bases 305 and 405 are reinforced by being supported by the pair of first terminal support walls 543 and the pair of second terminal support walls 545 in this manner, thereby allowing an increase in the life of the trigger switch 1.

Figure 7:
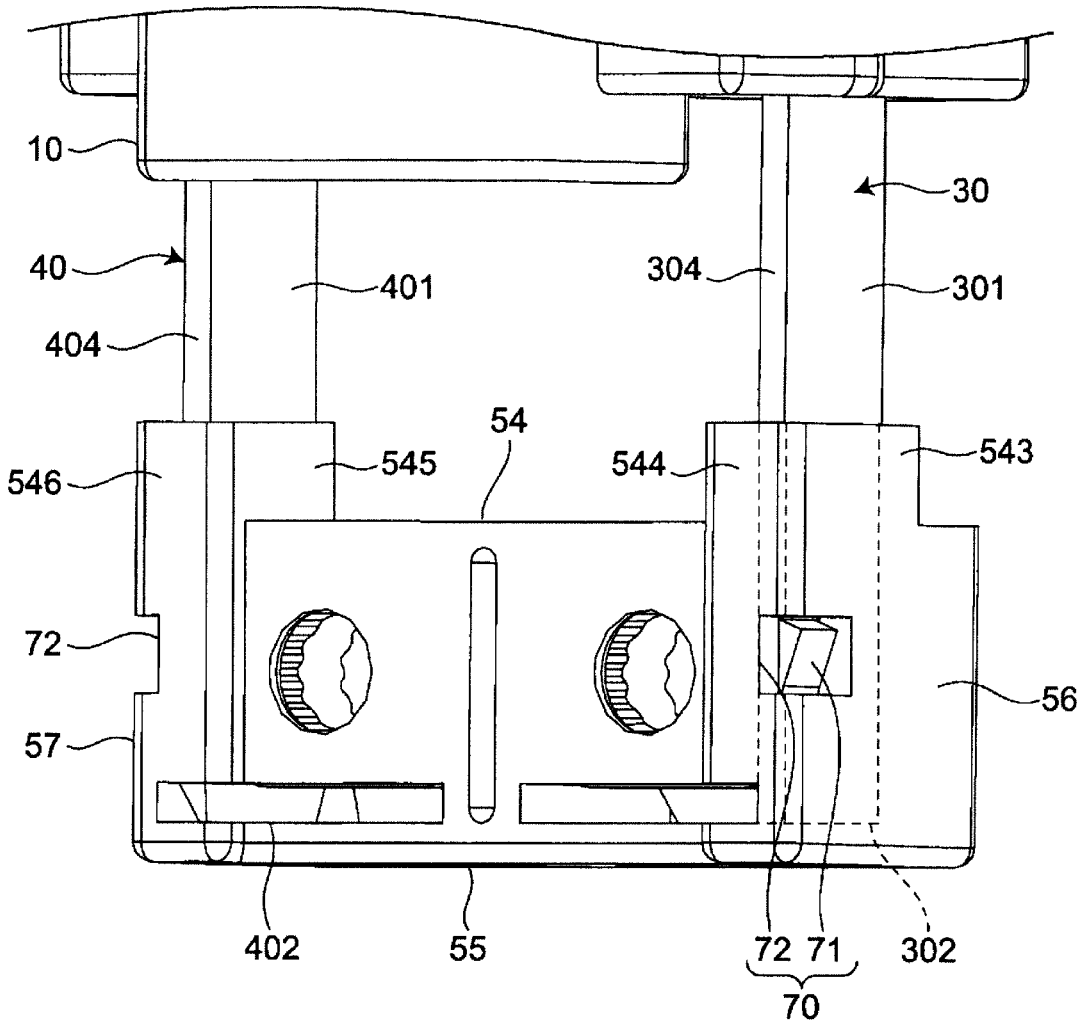
FIG. 7 is a partially enlarged perspective view of the periphery of the terminal cover member of the trigger switch of FIG. 1 as viewed from a direction different from that of FIG. 1.

As shown in FIG. 7, the trigger switch 1 includes a snap-fit portion 70 that enables the terminal cover member 50 to be positioned with respect to the first terminal 30 and the second terminal 40 and removably attached thereto. The snap-fit portion 70 includes a pair of engagement claws 71 (only one is shown in FIG. 7) and a pair of engagement holes 72. Each of the pair of engagement holes 72 is provided in the first side wall 56 and the second side wall 57 of the terminal cover member 50 and allows the corresponding engagement claw 71 to be locked.

Each of the pair of engagement claws 71 is provided to outside plate surfaces of the ends 302 and 402, which are located outside of the housing 10, of the first terminal body 301 and the second terminal body 401 (i.e., a surface of the first terminal body 301 facing the first side wall 56 and a surface of the second terminal body 401 facing the second side wall 57). The engagement claw 71 of the first terminal body 301 is disposed to be engageable with the engagement hole 72 of the first side wall 56 which faces the engagement claw 71 of the first terminal body 301 in a state in which the first wire connection portion 31 is housed in the first casing 51. The engagement claw 71 of the second terminal body 401 is disposed to be engageable with the engagement hole 72 of the second side wall 57 which faces the engagement claw 71 of the second terminal body 401 in a state in which the second wire connection portion 41 is housed in the second casing 52.

Since the terminal cover member 50 can be removably attached to the first terminal 30 and the second terminal 40 by the snap-fit portion 70 in this manner, the assembly of the trigger switch 1 is facilitated, and productivity of the trigger switch 1 can be improved.

The terminal cover member 50 may be eliminated if possible.

Only one of the pair of first terminal support walls 543 may be provided, and only one of the pair of second terminal support walls 545 may be provided.

The terminal cover member 50 is not limited to being attached to the first terminal 30 and the second terminal 40 by the snap-fit portion 70. With respect to an attachment structure of the terminal cover member 50 to the first terminal 30 and the second terminal 40, it is possible to adopt any structure depending on design of the trigger switch, including whether the terminal cover member 50 is removable or not.

While the various embodiment(s) of the present disclosure has/have been described in detail with reference to the drawings, various aspects of the present disclosure will be finally described. In the following description, reference signs will also be used as an example.

A trigger switch 1 according to a first aspect of the present disclosure comprises:

a housing 10 internally including a casing 11;

a trigger 20 provided to an exterior of the housing 10 and coupled to the housing 10 to be capable of approaching and separating from the housing 10;

a contact mechanism 2 including a fixed contact 12 provided in the casing 11 and a movable contact 13 provided in the casing 11 to face the fixed contact 12, the movable contact 13 making contact with and separating from the fixed contact 12 in conjunction with approaching and separating operation of the trigger 20 with respect to the housing 10;

a first terminal 30, which has a plate shape, fixed to the housing 10 and electrically connected to the contact mechanism 2, the first terminal extending from outside the housing 10 to the casing 11; and a second terminal 40, which has a plate shape, fixed to the housing 10 and electrically connected to the contact mechanism 2, the second terminal extending from outside the housing 10 to the casing 11 and including a plate surface facing a plate surface of the first terminal 30 and being disposed in parallel with the first terminal 30, wherein a first wire connection portion 31 capable of connecting a conductor portion 64 of a first wire is provided to an end 302 of the first terminal 30 located outside of the housing 10 in an extending direction of the first terminal 30, and a second wire connection portion 41 capable of connecting a conductor portion 65 of a second wire is provided to an end 402 of the second terminal 40 located outside of the housing 10 in an extending direction of the second terminal 40.

With the trigger switch 1 according to the first aspect, for example, as compared with a trigger switch in which a wire connection portion is provided in a housing, it is possible to miniaturize the housing 10 and cope with the reduction in the size and weight of electric tools.

The trigger switch 1 according to a second aspect of the present disclosure further comprises, an insulating terminal cover member 50 provided outside the housing 10, the terminal cover member 50 including a first casing 51 that houses the first wire connection portion 31 and a second casing 52 that houses the second wire connection portion 41, wherein the terminal cover member 50 includes:

a partition wall 53 that extends in the extending direction of the first terminal 30 and the second terminal 40 and partitions the first casing 51 and the second casing 52, thereby providing electrical isolation between the first casing 51 and the second casing 52;

a terminal insertion surface 54 that extends in a direction intersecting the partition wall 53, the terminal insertion surface 54 being capable of inserting the first wire connection portion 31 and the second wire connection portion 41 therethrough respectively;

a wire connection surface 55 that is disposed to face the terminal insertion surface 54, the wire connection surface 55 being capable of connecting the conductor portion 64 of the first electric wire and the conductor portion 65 of the second electric wire therethrough respectively;

a first side wall 56 that faces the partition wall 53 and supports the first terminal 30 inserted through the terminal insertion surface 54;

a first support wall 58 that extends along the wire connection surface 55 and that supports and positions the first wire connection portion 31 inserted through the terminal insertion surface 54;

a second side wall 57 that faces the partition wall 53 and is disposed on an opposite side of the partition wall 53 to the first side wall 56, and that supports the second terminal 40 inserted through the terminal insertion surface 54; and a second support wall 59 that extends along the wire connection surface 55 and is disposed on the opposite side of the partition wall 53 to the first support wall 58, and that supports and positions the second wire connection portion 41 inserted through the terminal insertion surface 54.

With the trigger switch 1 according to the second aspect, it is possible to provide isolation between the first wire connection portion 31 and the second wire connection portion 41 with a simple configuration, and easily connect the first wire connection portion 31 to the conductor portion 64 of the first wire and easily connect the second wire connection portion 41 to the conductor portion 65 of the second wire.

The trigger switch 1 according to the third aspect of the present disclosure, wherein the terminal cover member 50 includes:

a first terminal support wall 543 that extends from the wire connection surface 55 along the plate surface of the first terminal 30 toward the housing 10 and supports the first terminal 30, and a second terminal support wall 545 that extends from the wire connection surface 55 along the plate surface of the second terminal 40 toward the housing 10 and supports the second terminal 40.

With the trigger switch 1 according to the third aspect, it is possible to support the respective portions of the first terminal 30 and the second terminal 40 which are prone to stress concentration, and therefore increase the life of the trigger switch 1.

The trigger switch 1 according to a fourth aspect of the present disclosure, wherein the first terminal support wall 543 is provided on both sides of the first terminal 30 in a plate thickness direction, and the second terminal support wall 545 is provided on both sides of the second terminal 40 in a plate thickness direction.

With the trigger switch 1 according to the fourth aspect, it is possible to more reliably support the respective portions of the first terminal 30 and the second terminal 40 which are prone to stress concentration, and therefore more reliably increase the life of the trigger switch 1.

The trigger switch 1 according to a fifth aspect of the present disclosure further comprises a snap-fit portion 70 removably attached to the first terminal 30 and the second terminal 40 while positioning the terminal cover member 50 with respect to the first terminal 30 and the second terminal 40, wherein the snap-fit portion 70 includes a pair of engagement claws 71 provided to the ends of the first terminal 30 and the second terminal 40 located outside of the housing 10, and a pair of engagement holes 72 provided in the terminal cover member 50 and lockable with the pair of engagement claws 71.

With the trigger switch 1 according to the fifth aspect, the assembly of the trigger switch 1 is facilitated, and the productivity of the trigger switch 1 can be improved.

It should be understood that advantageous effects may be obtained by combining, as appropriate, any of the above various embodiment(s) or modification(s). Further, any combination of the embodiments, combination of the examples, or combination of both are possible, and any combination of features in different embodiments or examples are also possible.

While the present disclosure has been fully described in connection with the preferred embodiment with reference to the accompanying drawings, various changes and modifications will be apparent to those skilled in the art. Such changes and modifications are to be understood as included within the scope of the present disclosure as set forth in the appended claims, unless they depart therefrom.

INDUSTRIAL APPLICABILITY

The trigger switch of the present disclosure can be applied to power tools such as electric screwdrivers.

REFERENCE SIGNS LIST

1. trigger switch
2. contact mechanism
10. housing
101. wall
11. casing
12. fixed contact
13. movable contact
14. movable contact piece
15. supporting portion
20. trigger
21. operation body
211. curved surface
22. operation shaft
23. return spring
24. plunger
30. first terminal
31. first wire connection portion
32. through hole
301. first terminal body
302. end
303. first side surface
304. second side surface
305. base
40. second terminal
41. second wire connection portion
42. through hole
401. second terminal body
402. end
403. first side surface
404. second side surface
405. base
50. terminal cover member
51. first casing
52. second casing
53. partition wall
54. terminal insertion surface
541. first terminal insertion opening
542. second terminal insertion opening
543. first terminal support wall
544. first connection wall
545. second terminal support wall
546. second connection wall
55. wire connection surface
551. first wire connection opening
552. second wire connection opening
56. first side wall
57. second side wall
58. first support wall
59. second support wall
61. crimp terminal
62. screw
63. nut
64, 65. conductor portion
70. snap-fit portion
71. engagement claw
72. engagement hole

The invention claimed is:

1. A trigger switch comprising:

a housing internally including a casing;

a trigger provided to an exterior of the housing and coupled to the housing to be capable of approaching and separating from the housing;

a contact mechanism including a fixed contact provided in the casing and a movable contact provided in the casing to face the fixed contact, the movable contact making contact with and separating from the fixed contact in conjunction with approaching and separating operation of the trigger with respect to the housing;

a first terminal, which has a plate shape, fixed to the housing and electrically connected to the contact mechanism, the first terminal extending from outside of the housing to the casing;

a second terminal, which has a plate shape, fixed to the housing and electrically connected to the contact mechanism, the second terminal extending from outside of the housing to the casing and including a plate surface facing a plate surface of the first terminal and being disposed in parallel with the first terminal, and an insulating terminal cover member provided outside the housing, the terminal cover member comprising:

a first casing that houses a first wire connection portion and a second casing that houses a second wire connection portion;

a partition wall that extends in the extending direction of the first terminal and the second terminal and that partitions the first casing and the second casing, thereby providing electrical isolation between the first casing and the second casing;

a terminal insertion surface that extends in a direction intersecting the partition wall, the terminal insertion surface being capable of inserting the first wire connection portion and the second wire connection portion therethrough respectively;

a wire connection surface that is disposed to face the terminal insertion surface, the wire connection surface being capable of connecting a conductor portion of a first wire and a conductor portion of a second wire therethrough respectively;

a first side wall that faces the partition wall and that supports the first terminal inserted through the terminal insertion surface;

a first support wall that extends along the wire connection surface and that supports and positions the first wire connection portion inserted through the terminal insertion surface;

a second side wall that faces the partition wall and is disposed on an opposite side of the partition wall to the first side wall, and that supports the second terminal inserted through the terminal insertion surface; and a second support wall that extends along the wire connection surface and is disposed on the opposite side of the partition wall to the first support wall, and that supports and positions the second wire connection portion inserted through the terminal insertion surface, wherein the first wire connection portion capable of connecting the conductor portion of the first wire is provided to an end of the first terminal located outside of the housing in the extending direction of the first terminal, wherein the second wire connection portion capable of connecting the conductor portion of the second wire is provided to an end of the second terminal located outside of the housing in the extending direction of the second terminal, wherein the housing and the terminal cover member are disposed at intervals in the extending direction of the first terminal without contacting each other, and wherein a part of the first terminal and a part of second terminal are located outside the housing and the terminal cover member.

2. The trigger switch according to claim 1, wherein the terminal cover member further comprising:

a first terminal support wall that extends from the wire connection surface along the plate surface of the first terminal toward the housing and that supports the first terminal; and a second terminal support wall that extends from the wire connection surface along the plate surface of the second terminal toward the housing and that supports the second terminal.

3. The trigger switch according to claim 2, wherein the first terminal support wall is provided on both sides of the first terminal in a plate thickness direction, and the second terminal support wall is provided on both sides of the second terminal in a plate thickness direction.

4. The trigger switch according to claim 1, further comprising a snap-fit portion removably attached to the first terminal and the second terminal while positioning the terminal cover member with respect to the first terminal and the second terminal, wherein the snap-fit portion comprising a pair of engagement claws provided to the ends of the first terminal and the second terminal located outside of the housing, and a pair of engagement holes provided in the terminal cover member and lockable with the pair of engagement claws.

5. The trigger switch according to claim 2, further comprising a snap-fit portion removably attached to the first terminal and the second terminal while positioning the terminal cover member with respect to the first terminal and the second terminal, wherein the snap-fit portion comprising a pair of engagement claws provided to the ends of the first terminal and the second terminal located outside of the housing, and a pair of engagement holes provided in the terminal cover member and lockable with the pair of engagement claws.

6. The trigger switch according to claim 3, further comprising a snap-fit portion removably attached to the first terminal and the second terminal while positioning the terminal cover member with respect to the first terminal and the second terminal, wherein the snap-fit portion comprising a pair of engagement claws provided to the ends of the first terminal and the second terminal located outside of the housing, and a pair of engagement holes provided in the terminal cover member and lockable with the pair of engagement claws.

* * * * *